United States Patent [19]

Drzewiecki et al.

[11] 4,164,961

[45] Aug. 21, 1979

[54] FLUIDIC PRESSURE/FLOW REGULATOR

[75] Inventors: Tadeusz M. Drzewiecki, Silver Spring; Francis M. Manion, Rockville, both of Md.

[73] Assignee: The United States of America as represented by the Secretary of the Army, Washington, D.C.

[21] Appl. No.: 819,786

[22] Filed: Jul. 28, 1977

[51] Int. Cl.[2] ..... F15C 1/14

[52] U.S. Cl. ..... 137/823; 137/832; 137/837

[58] Field of Search ..... 137/823, 832, 836, 837

[56] References Cited

U.S. PATENT DOCUMENTS

| | | | |
|---|---|---|---|
| 3,209,774 | 10/1965 | Manion | 137/823 |
| 3,250,469 | 5/1966 | Colston | 137/818 |
| 3,266,510 | 8/1966 | Wadey | 137/836 |
| 3,335,737 | 8/1967 | Gesell | 137/832 |
| 3,457,936 | 7/1969 | White et al. | 137/816 |
| 3,680,578 | 8/1972 | Davies | 137/836 X |

FOREIGN PATENT DOCUMENTS

| | | | |
|---|---|---|---|
| 1324371 | 7/1973 | United Kingdom | 137/832 |

*Primary Examiner*—William R. Cline

*Attorney, Agent, or Firm*—Nathan Edelberg; Robert P. Gibson; Saul Elbaum

[57] ABSTRACT

A fluidic flow or pressure regulator which utilizes a linear and a non-linear resistance arranged in parallel supplying control passages to change the direction of a jet as a function of the pressure of an unregulated fluid source. An output means is provided which can supply fluid having pressure which is a desired function of the unregulated pressure, including a constant pressure. One embodiment forms the variable direction jet solely from the two control passages while another embodiment uses the control passages to change the direction of a power jet.

7 Claims, 3 Drawing Figures

FLUIDIC PRESSURE/FLOW REGULATOR

RIGHTS OF THE GOVERNMENT

The invention described herein may be manufactured, used, and licensed by or for the United States Government for governmental purposes without the payment to us of any royalty thereon.

BACKGROUND OF THE INVENTION

In many pneumatic and hydraulic applications a constant or predetermined pressure or flow is required. Constant pressure is generally provided by a feedback diaphragm-type pressure regulator or some other device that requires gain and a feedback signal. Constant flow is often achieved by using a choked flow orifice or a supply that has a flow resistance considerably higher than the circuit it operates. In such a manner small changes in the small resistance are even smaller percentage changes of the overall resistance, hence the flow changes are small. This, however, is not sufficient if the supply pressure changes, for in that case the flow is not regulated at all.

SUMMARY OF THE INVENTION

It is therefore an object of the instant invention to provide a flow or pressure regulator capable of producing a predetermined flow or pressure without the use of feedback means.

It is a further object of the instant invention to provide a passive pressure function generator in which the input pressure alone produces the desired pressure function.

Another object of the invention is to provide a pressure regulator capable of providing a constant output pressure over a wide range of supply pressures.

Briefly, in accordance with the instant invention, there is provided a flow or pressure regulator having a plurality of channels supplied by an unregulated pressure source. The channels have different flow resistance characteristics, for example, one may have an orifice and another a laminar flow resistance, thus producing flow rates through the channels that vary in proportion to each other as the supply pressure varies. This variation is used to control the direction of the jet formed by the fluid issuing from the channels and thus the flow or pressure in the output channel.

Additional objects, features, and advantages of the instant invention will become apparent to those skilled in the art from the following detailed description and attached drawings on which the preferred embodiments of the invention are illustrated.

DESCRIPTION OF THE PREFERRED EMBODIMENTS

By examining the basic phenomena of jets, jet deflection, and subsequent pressure and flow recovery, it can be seen that as the pressure and flow to the jet increases the recovery increases, provided the jet does not deflect away from the receiving aperture. Now, by producing a differential pressure or flow signal proportional to the supply pressure or flow to deflect the jet away from the receiver, the increased pressure recovery can be cancelled by a jet deflection.

If two fluid resistors of different value are supplied from a common source and vent to a common ambient condition, then the flow difference between these two will be a function of the supply pressure (flow). This is easily understood if the following mathematical arguments are followed. The relationship, for any fluid resistor, between pressure and flow may be written as $$\Delta P = RQ + KQ^2$$

where ΔP is the pressure drop, Q the flow passed, R the linear resistance and K the orifice resistance factor.

The flow, then, through such a resistor can be written as the solution of the quadratic equation $$Q^2 + (R/K)Q - (\Delta P/K) = 0$$

so that $$Q = (-R/2K) \pm \sqrt{(R^2/2K) + (\Delta P/K)}$$

where the positive root must be used to allow for positive and negative values of flow.

For a pure orifice (R=0)

$$Q = \sqrt{(\Delta P/K)}$$

and for a purely linear resistor $$Q = (\Delta P/R)$$

In this manner one can see that the difference flow between two dissimilar linear resistors is $$\Delta Q = Q_1 - Q_2 = \Delta P(1/R_1 - 1/R_2)$$

and between an orifice and a linear resistor $$\Delta Q = (\Delta P/R_1) - (\Delta P/K_2)^{\frac{1}{2}}.$$

If this flow difference is used to steer a main jet emanating from an orifice where $$Q_{jet} = \sqrt{\Delta P/K_{jet}}$$

then for the purely linear resistors $$\Delta Q/Q_{jet} = K_{jet}Q_{jet}(1/R_1 - 1/R_2)$$

or for an orifice and a linear resistor $$\Delta Q/Q_{jet} = K_{jet}Q_{jet}/R_1 - \sqrt{K_{jet}/K_2}.$$

In each case it is apparent that the relative controlling flow increases linearly with increasing jet flow, or simply with supply pressure. It is clear then that if a jet deflection device is constructed in such a manner that the control jets emanate from resistors of different, but predescribed, channels then a jet deflection will occur that is related to the supply pressure. In a device with a single output and a supply jet channel pointed directly at the output, using the more general linear and orifice combination will result in a jet deflection at low flows to one side, a centered jet when the two resistors are equal, and the jet deflected to the other side at high flows as shown in the bottom two graphs of FIG. 1. If one assumes that the region between the output and the supply is at a constant pressure (vent pressure usually ambient) then the output pressure will assume the general shape with respect to supply pressure shown in the top graph of FIG. 1.

Figure 1:
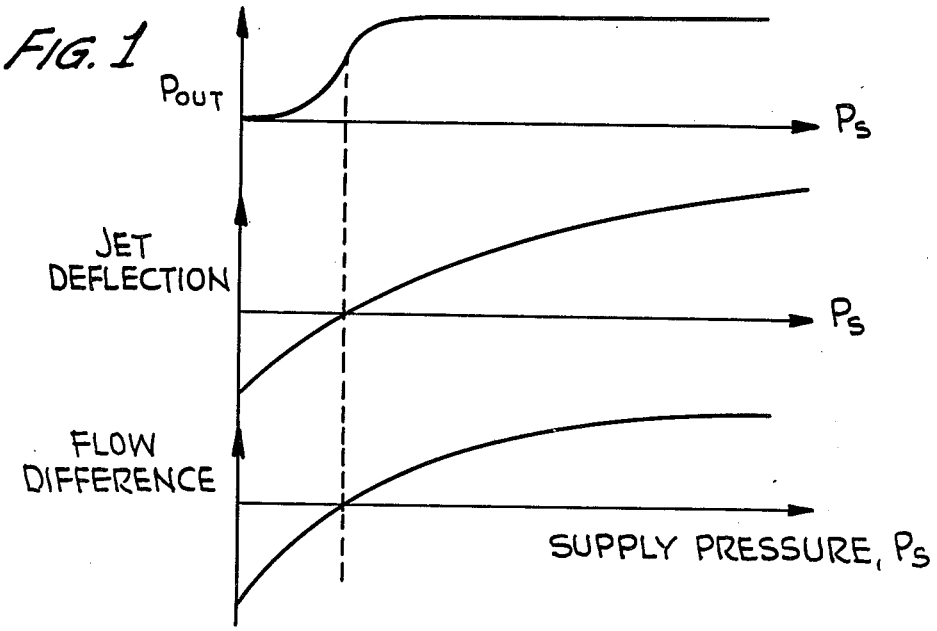
FIG. 1 is a series of graphs illustrating the principal on which the invention is based.

Notice in FIG. 1 that as the supply pressure increases the output pressure rises rapidly at first and then assumes an almost constant value. This may be made to droop or increase depending on the desired shaping.

Figure 2:
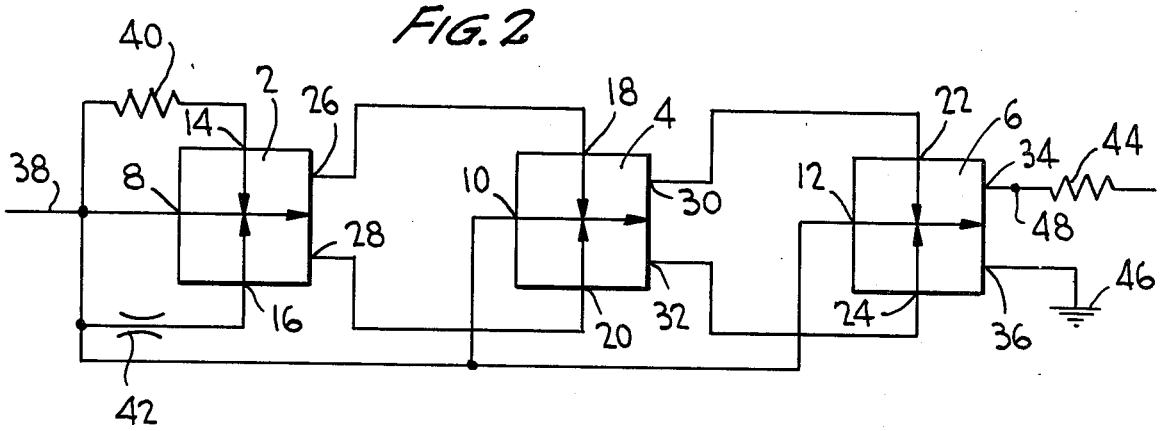
FIG. 2 is a schematic view of a regulator illustrating one embodiment of the invention.

FIG. 2 illustrates an embodiment of the present invention which utilizes three stages of amplification. In this device three proportional fluidic amplifiers 2, 4 and 6 have their power jets 8, 10 and 12, respectively, supplied from an unregulated pressure source by line 38.

Also supplied by line 38 are linear resistor 40 and orifice 42 which respectively supply control ports 14 and 16 of fluidic amplifier 2. Linear resistor 40 is a laminar flow element, well known in the art. Outputs 26 and 28 then supply control ports 18 and 20 of amplifier 4, and in turn, outputs 30 and 32 supply control ports 22 and 24 of amplifier 6. Discharge ports 34 and 36 of amplifier 6 then discharge to load 44 and to ambient pressure at 46.

In operation the regulator of FIG. 2, starting at low supply pressure, would have a significantly greater flow through orifice 42 than through linear resistor 40. Accordingly most of the output of amplifier 2 would be through discharge port 26 which would drive second stage amplifier 4 to discharge through port 32 and accordingly drive third stage amplifier 6 to direct its output to load 44. As supply pressure in line 38 increases a progressively greater proportion of the flow through elements 40 and 42 would be through linear resistance 40. Accordingly as supply pressure increases a progressively greater amount of the discharge from third stage amplifier 6 would be to ambient pressure at 46. In this manner the discharge pressure at 48 is regulated.

Figure 3:
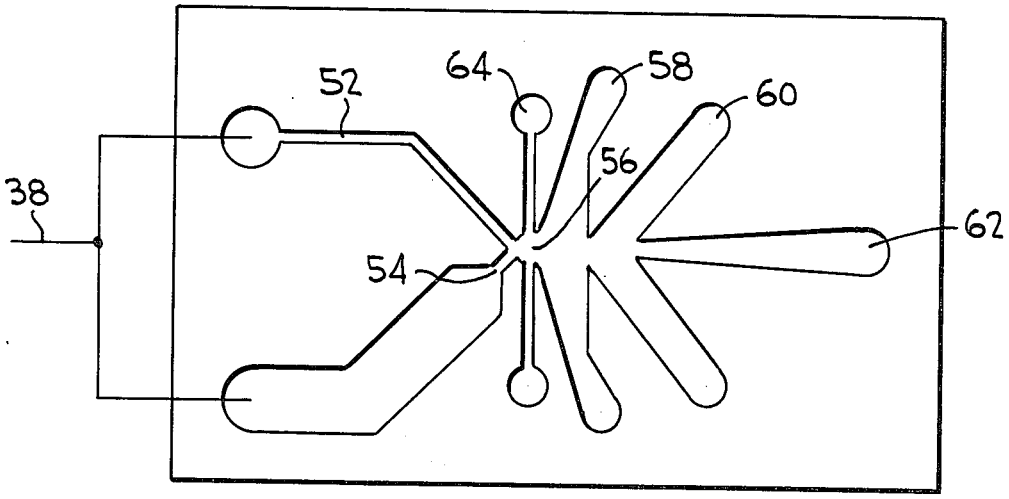
FIG. 3 is a schematic view of an alternative embodiment of the instant invention.

FIG. 3 illustrates another embodiment of the invention based on the following phenomena. When two jets of about the same momentum are impinged on one another they form a new single jet whose deflection angle is dependent on the ratio of momenta. If the two jets emanate from dissimilar resistors there will be a jet deflection as a function of the supply pressure if both are supplied from the same pressure source.

The FIG. 3 device utilizes two jets emanating from linear resistor 52 and orifice 54. Both of these jets are supplied from the same pressure source by line 38 and serve to form a single jet in interaction region 56. This single jet will have a direction that is a function of the supply pressure, as previously outlined. The interaction region is provided with vents 58 and 60 and outlet 62. Outlet 62 then produces a regulated pressure. The regulator is additionally provided with auxiliary control ports 64 which may be used to provide further shaping of the output characteristics. The regulator of FIG. 3 has sufficient gain, when vented to ambient, to provide a constant output pressure for over a 5 to 1 change in supply pressure.

We wish it to be understood that we do not desire to be limited to the exact details of construction shown and described, for obvious modifications can be made by a person skilled in the art.

We claim:

1. A fluidic flow regulator comprising:

a fluid inlet for connection to a source of unregulated fluid;

power jet means comprising a plurality of channels communicating with said fluid inlet, said channels being oriented to issue streams of fluid that converge to form a jet of fluid, the flow resistance of the first of said channels having a generally linear flow rate versus pressure drop characteristic and the flow resistance of the second of said channels having a flow rate that varies approximately as the square root of the pressure drop, to provide a jet of fluid whose direction varies solely as a function of the pressure of said unregulated fluid; and output means to divide said jet of fluid into a discharge stream and a regulated stream, said output means being positioned to increase the proportion of said jet of fluid going to said discharge stream as the presssure of said jet of fluid increases.

2. The flow regulator of claim 1 wherein said first channel includes a laminar flow resistance element and said second channel includes an orifice.

3. The flow regulator of claim 1 wherein a third one of said channels is arranged between said first and second channel.

4. The flow regulator of claim 1 wherein said power jet means includes only two channels communicating with said fluid inlet (said channels being oriented to issue streams of fluid that converge to form said jet of fluid, and said channels have flow resistance characteristics different from each other).

5. The flow regulator of claim 4 wherein one of said channels includes a laminar flow resistance element and said second channel includes an orifice.

6. A pressure regulator for providing fluid at a regulated pressure from a source of fluid having an unregulated pressure, said regulator comprising:

a first proportional fluidic amplifier having a power jet, two discharge ports, and just two control ports;

at first fluid line, including a laminar flow element, for connecting the first of said control ports to said source of fluid to provide the sole source of fluid to the first of said control ports;

a second fluid line, including an orifice, for connecting the second of said control ports to said source of fluid to provide the sole source of fluid to the second of said control ports; and a third fluid line for connecting said power jet to said source of fluid;

whereby one of said discharge ports provides a source of pressure regulated fluid without need for a feedback connection from said discharge ports.

7. The pressure regulator of claim 6 further comprising a second proportional fluidic amplifier having a power jet, two discharge ports, and just two control ports, wherein the first of said control ports of said second amplifier is supplied by one of said discharge ports of said first amplifier, the second of said control ports of said second amplifier is supplied by the other of said discharge ports of said first amplifier, and said power jet of said second amplifier is supplied by said source of fluid.

* * * * *